US006827613B2

(12) United States Patent
Ferderer

(10) Patent No.: US 6,827,613 B2
(45) Date of Patent: Dec. 7, 2004

(54) ELECTRICAL CONTACT ELEMENT, IN PARTICULAR A CONTACT ELEMENT FORMED AS PIN CONTACT OR SOCKET CONTACT

(75) Inventor: Albert Ferderer, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 17 days.

(21) Appl. No.: 10/300,562

(22) Filed: Nov. 20, 2002

(65) Prior Publication Data

US 2003/0104732 A1 Jun. 5, 2003

(30) Foreign Application Priority Data

Dec. 1, 2001 (DE) ..... 201 19 530

(51) Int. Cl.[7] ..... H01R 4/38; H01R 4/50

(52) U.S. Cl. ..... 439/805; 439/462; 439/863; 439/439

(58) Field of Search ..... 403/281; 439/461–462, 439/805, 439, 584, 863–868, 438–441, 411–437; 174/21 C, 75 C, 88 C

(56) References Cited

U.S. PATENT DOCUMENTS

| | | | | | |
|---|---|---|---|---|---|
| 2,147,255 | A | | 2/1939 | Hoppenstand | 173/269 |
| 2,959,766 | A | | 11/1960 | Jacobsen | 439/863 |
| 3,195,933 | A | * | 7/1965 | Jacobs | 285/247 |
| 4,150,250 | A | * | 4/1979 | Lundeberg | 174/65 SS |
| 5,123,860 | A | * | 6/1992 | Kamei et al. | 439/462 |
| 5,362,251 | A | * | 11/1994 | Bielak | 439/394 |
| 6,080,008 | A | * | 6/2000 | Frantz | 439/441 |
| 6,123,567 | A | * | 9/2000 | McCarthy | 439/427 |
| 6,149,455 | A | * | 11/2000 | Levi | 439/462 |
| 6,319,046 | B1 | | 11/2001 | Feye-Hohmann et al. | 439/359 |

FOREIGN PATENT DOCUMENTS

| | | | |
|---|---|---|---|
| CH | 600 617 | 6/1978 | H01R/13/58 |
| DE | 296 07 505 U 1 | 4/1996 | H01R/4/50 |
| DE | 199 14 308 A 1 | 3/1999 | H01R/4/24 |
| GB | 245586 | 1/1926 | |

* cited by examiner

*Primary Examiner*—Michael C. Zarroli
(74) *Attorney, Agent, or Firm*—Hayes Soloway P.C.

(57) ABSTRACT

For use in already known plug connections, an electrical contact element is proposed that can be formed as a socket contact or as a pin contact and is provided with a plug region and a terminal end, a sleeve being capable of being screwed onto the terminal end of the contact element. The sleeve has inwardly directed spring arms that enter into a conical bore in the terminal end. Positioned between said spring arms is an electrical conductor, the spring arm tips exerting a force-locking wedge action on the electrical conductor to an ever greater extent, the further the sleeve is screwed onto the terminal end.

2 Claims, 2 Drawing Sheets

ELECTRICAL CONTACT ELEMENT, IN PARTICULAR A CONTACT ELEMENT FORMED AS PIN CONTACT OR SOCKET CONTACT

BACKGROUND OF THE INVENTION

1. Field of the Invention

The invention relates to an electrical contact element, in particular a contact element formed as pin contact or socket contact, having a plug region and a terminal end for connecting an electrical conductor.

Such a contact element, which is as a rule surrounded by an insulating housing, is needed in order to make an electrical connection between an electrical conductor and a terminal end of an electrical pin contact or of a socket contact, without, however, any special tool being necessary.

2. Description of the Prior Art

A number of connection principles are known in technology for connecting electrical conductors to a contact element, such as by means of soldering, by means of screw terminals, by a cage clamp terminal or alternatively by crimp terminals.

DE 199 14 308 A1 discloses an electrical terminal unit having a housing, in which at least one terminal for an insulated conductor or a stripped conductor is provided that has at least one cutting element and at least one spring element.

Disadvantages in such cases are that various connecting principles, such as, for example, soldering, are steadily losing ground in industrial connecting technology because of the expense, and that screw terminals as well as cage clamp terminals have a relatively large space requirement and crimp terminals always require a special tool.

The object of the invention is therefore to construct a contact element of the type mentioned at the outset in such a way that at least one contact element that is already in use and has a crimp or screw terminal can be replaced by or exchanged for the contact element according to the invention without difficulty, at least comparable contacting data, such as contact resistances and gastight connecting points between an electrical conductor and a contact element, being achieved with this connecting technology to that in the case of a crimp terminal, but without needing the special tool, for example a crimping tool.

SUMMARY OF THE INVENTION

This object is achieved in that a sleeve can be mounted on the terminal end, in that the sleeve has spring arms stamped out of its wall and directed into the sleeve interior, and in that the spring arms enter a bore in the terminal end of the contact element.

Advantageous embodiments of the invention are specified in claims 2–5.

The advantages achieved by the invention are, in particular, that the outer contours of such contact elements formed as pin or socket contacts are adapted to already existing plug connector systems that are in use and, consequently, older versions that are provided with a crimp, screw or solder terminal can readily be replaced, without a special tool of any kind being needed. In addition, almost identical conductor pull-out forces are achieved with this type of attachment as in the case of a screw terminal.

Furthermore, it is advantageous that the terminal cross section of the electrical conductor for the contact element according to the invention covers a greater range of variation than is possible in the case of a crimp terminal; thus, in total, cross-sectional areas of 0.5 to 2.5 $mm^2$ are connectable. As a result of the formation of a sawtooth thread at the terminal end of the contact element, the wedge action of the tips of the spring arms exerted on the electrical conductor is advantageously achievable not only by a rotary movement, but also, optionally, by an axially latching action of the sleeve. The wedge action of the spring arm tips achieves, in addition, a vibration-proof and extraction-proof attachment technology for the electrical conductor.

BRIEF DESCRIPTION OF THE DRAWINGS

An exemplary embodiment of the invention is shown in the drawing and is explained in greater detail below. In the drawing.

DETAILED DESCRIPTION OF A PREFERRED EMBODIMENT

Figure 1:
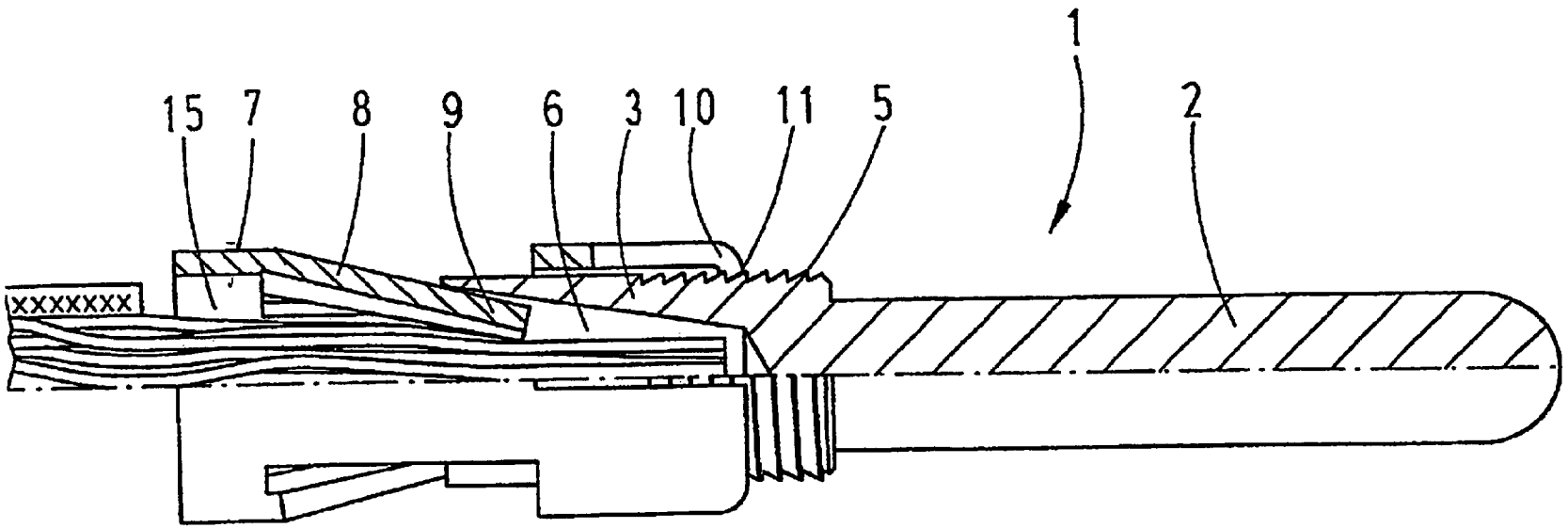
FIG. 1 shows a sectional view of a complete contact element having a screwed-on sleeve.

FIG. 1 shows a contact element 1 formed as a pin contact and having a sleeve 7 and an electrical conductor 15 inserted therein. The contact element is formed from a pin-shaped plug region 2 having an adjoining terminal end 3 on which a sawtooth thread 5 is provided.

Furthermore, a cone-shaped bore 6 is provided into which there enter two spring arms 8 that have been cut out of the outside surface of the sleeve 7.

Figure 2:
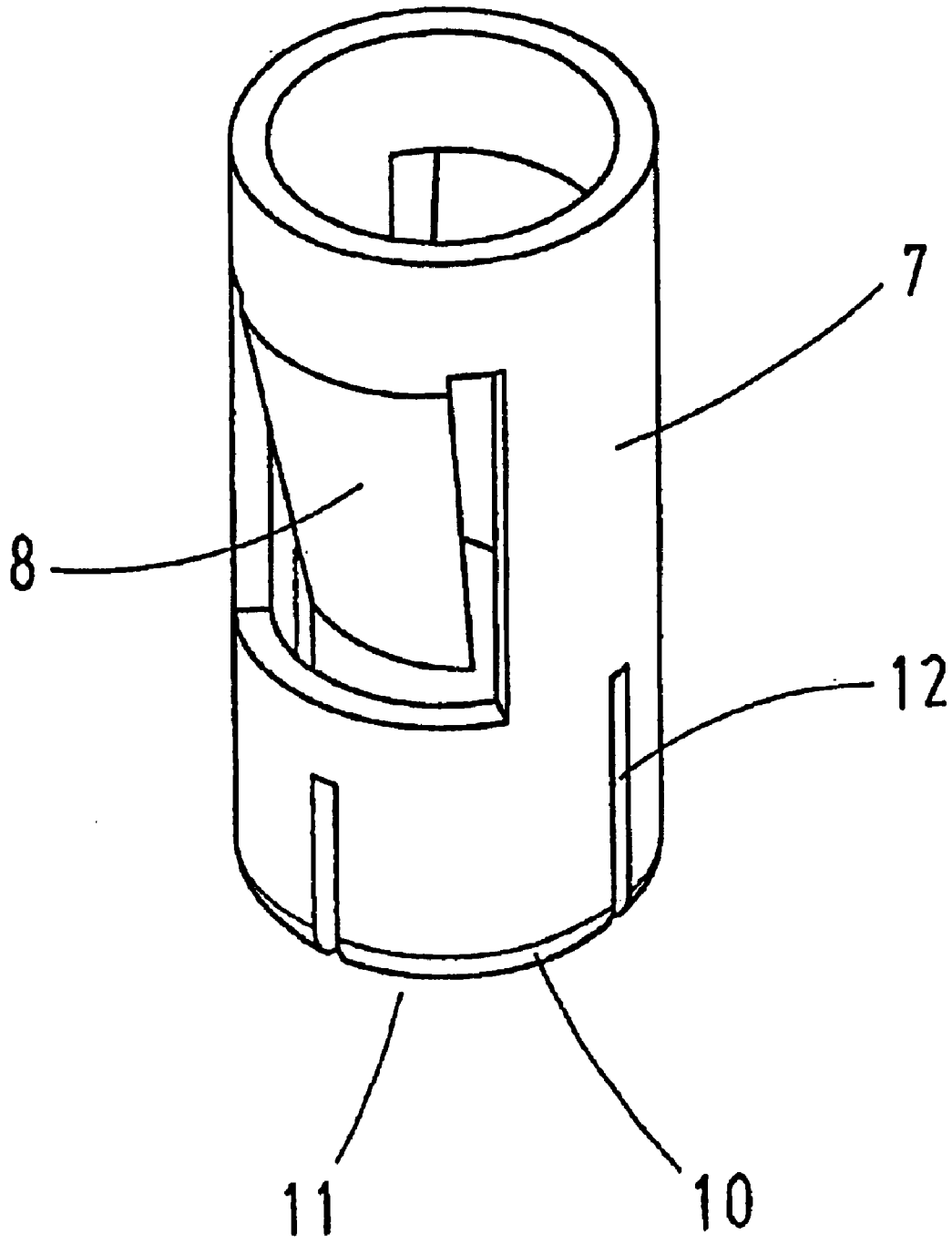
FIG. 2 shows a perspective view of the sleeve.

The sleeve 7 shown in FIG. 2 has, in this example, two spring arms 8 that have been cut or punched out of the outside surface of the sleeve and point into the interior of the sleeve.

Formed onto the sleeve end and pointing in the direction of the spring arms is a collar 10 whose rim 11, which points into the interior of the sleeve, is shaped to match the tooth edges of the sawtooth thread 5.

Furthermore, a plurality of slots 12 are provided that, proceeding from the collar 10, extend axially into the outer surface of the sleeve.

When the contact element is fitted with a stripped electrical conductor 15, the latter is first introduced into the sleeve 7 and pushed in up to the stop in the bore 6 in the terminal end 3. During this process, the conductor slides past the spring arms 8 directed into the interior of the sleeve.

Then, as a result of an axial displacement of the sleeve in the direction of the plug region 2 of the contact element, the spring arms already situated in the funnel-shaped or cone-shaped bore 6 of the terminal region are pushed deeper into the bore, the electrical conductor being wedged—increasingly according to the force action—between the spring arm tips 9. The sleeve is displaced rapidly and simply in this process by an axial sliding movement or, alternatively, by a rotary movement of the sleeve on the sawtooth thread 5 of the pin contact.

At the same time, the sleeve is provided with a plurality of longitudinal slots 12, with the result that segments arise that also ensure a "ratchet-like" sliding over the thread teeth edges.

A removal of the electrical conductor 15 from the contact element is possible by rotating the sleeve 7 anticlockwise on the sawtooth thread 5.

What is claimed is:

1. A two piece electrical contact comprising (1) a pin contact or socket contact, having a plug region and a terminal end for connecting an electrical conductor, and (2) a sleeve mountable on the terminal end, said sleeve having integrally formed spring anus stamped out of its wall and directed into the sleeve interior, whereupon the spring arms enter a bore in the terminal end of the contact element, wherein a sawtooth thread is provided on the terminal end, a collar is formed onto the sleeve, said collar having a rim formed in such a way that the sleeve can be screwed onto the sawtooth thread, and the sleeve has a plurality of axial slots that extend from the collar in the direction of the middle of the sleeve.

2. The two piece electrical contact of claim 1, wherein the bore in the terminal end is conically shaped.

* * * * *